US009210750B2

(12) United States Patent
Van Der Veen et al.

(10) Patent No.: US 9,210,750 B2
(45) Date of Patent: Dec. 8, 2015

(54) LED LIGHTING SYSTEM

(71) Applicant: KONINKLIJKE PHILIPS N.V., Eindhoven (NL)

(72) Inventors: Geert Willem Van Der Veen, Eindhoven (NL); Wilhelmus Josephus Cornelissen, Eindhoven (NL); Tijmen Cornelis Van Bodegraven, Eindhoven (NL); Patrick Alouisius Martina De Bruycker, Nuenen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/388,437

(22) PCT Filed: Mar. 7, 2013

(86) PCT No.: PCT/IB2013/051827

§ 371 (c)(1),
(2) Date: Sep. 26, 2014

(87) PCT Pub. No.: WO2013/144745

PCT Pub. Date: Oct. 3, 2013

(65) Prior Publication Data

US 2015/0061515 A1 Mar. 5, 2015

Related U.S. Application Data

(60) Provisional application No. 61/615,927, filed on Mar. 27, 2012.

(30) Foreign Application Priority Data

Mar. 27, 2012 (EP) ..... 12161499

(51) Int. Cl.
*H05B 39/04* (2006.01)
*H05B 33/08* (2006.01)

(52) U.S. Cl.
CPC ..... *H05B 33/0815* (2013.01); *H05B 33/0851* (2013.01)

(58) Field of Classification Search
USPC ..... 315/291, 307, 224, 246, 247, 312
See application file for complete search history.

(56) References Cited

U.S. PATENT DOCUMENTS 8,941,316 B2 * 1/2015 King et al. ..... 315/244
8,947,016 B2 * 2/2015 Melanson et al. ..... 315/307

(Continued)

FOREIGN PATENT DOCUMENTS

EP 2239997 A1 10/2010
JP 2005093196 A 4/2005

(Continued)

*Primary Examiner* — Minh D A
(74) *Attorney, Agent, or Firm* — Meenakshy Chakravorty

(57) ABSTRACT

The invention relates to a LED lighting system comprising a power supply circuit for supplying a LED current, equipped with input terminals (K1, K2) for connection to a supply voltage source and output terminals (K3, K4), modulation circuitry (MS, DC2), coupled between the output terminals, for alternately maintaining the voltage between the output terminals at a high level during a first time interval and a low level during a second time interval, a current sensor (R1, R2, S1) for sensing the current through the output terminals during the second time interval, and a driver circuit (DC1, DC2), coupled between the input terminals and the output terminals and coupled to the current sensor, for generating the LED current, out of a supply voltage supplied by the supply voltage source, wherein the LED current equals the current sensed by the current sensor multiplied by a predetermined constant multiplication factor and for supplying the LED current to the output terminals during each first time interval. The LED lighting system further comprises a LED module comprising LED module input terminals (K5, K6) for connection to the output terminals of the power supply circuit, a LED load (LS) coupled between the LED module input terminals with a forward voltage that is higher than the voltage that is present between the output terminals of the power supply circuit during each second time interval, and a current source (CS) coupled between the input terminals for, in case the LED module input terminals are connected to the output terminals of a power supply source, during each second time interval generating a sensor current through the current sensor that is equal to a desired LED current divided by the predetermined constant multiplication factor.

5 Claims, 3 Drawing Sheets

(56) References Cited

U.S. PATENT DOCUMENTS

| | | | | |
|---|---|---|---|---|
| 2011/0006696 | A1 | 1/2011 | Menegazzi et al. | |
| 2011/0089855 | A1* | 4/2011 | Roberts et al. | 315/291 |
| 2011/0309759 | A1* | 12/2011 | Shteynberg et al. | 315/201 |

FOREIGN PATENT DOCUMENTS

| | | | |
|---|---|---|---|
| WO | 0148495 | A1 | 7/2001 |
| WO | 2010092504 | A1 | 8/2010 |
| WO | 2010109366 | A1 | 9/2010 |
| WO | 2011110981 | A2 | 9/2011 |

* cited by examiner

LED LIGHTING SYSTEM

CROSS-REFERENCE TO PRIOR APPLICATIONS

This application is the U.S. National Phase application under 35 U.S.C. §371 of International Application No. PCT/IB2013/051827, filed on Mar. 07, 2013, which claims the benefit of U.S. Provisional Patent Application No. 61/615,927, filed on Mar. 27, 2012, and European Patent Application No. 12161499.4 filed Mar. 27, 2013. These applications are hereby incorporated by reference herein.

FIELD OF THE INVENTION

The invention relates to a LED lighting system comprising a power supply circuit and one or more LED modules and to a method for operating one or more LED modules. More in particular the invention relates to a LED lighting system, wherein the power supply circuit adjusts the power supplied to the LEDs in the LED modules in dependency of signals generated by circuitry comprised in the LED modules, said signals in turn depending on the nominal power of the LEDs comprised in the LED module and preferably also on the temperature of the LEDs.

BACKGROUND OF THE INVENTION

Lighting systems based on LEDs are used on an increasing scale. LEDS have a high efficiency and a long life time. In many lighting systems, LEDs also offer a higher optical efficiency than other light sources. As a consequence LEDs offer an interesting alternative for the well known light sources such as fluorescent lamps, high intensity discharge lamps or incandescent lamps.

The lighting systems based on LEDs often comprise a power supply circuit that supplies power to the LEDs comprised in one or more LED modules that during operation are connected to output terminals of the power supply circuit. Typically the total current supplied by the power supply circuit depends on the number of LED modules connected to it and more in particular to the nominal current suitable for each of the LED modules and also on the temperature of the LED modules. The LED module LM comprised in a LED lighting system called Fortimo manufactured by Philips, that is presently on the market and shown in FIG. 1, comprises a first resistor Rset having a resistance that represents the nominal current suitable for the LEDs comprised in the LED module, and also comprises a second resistor NTC with a temperature dependent resistance. When such a LED module is connected to the power supply circuit PSC, a circuit MC comprised in the power supply circuit causes a current to flow through the first resistor Rset and another current through the second resistor NTC. The voltages across each of the resistors are measured and the value of the resistance of each of the resistors is determined by the circuit MC from the voltage across it. From these data, the circuit part MC derives a desired value for the LED current. A driver circuit DC comprised in the power supply circuit PSC subsequently adjusts the current supplied to the LED modules to the desired value.

An important disadvantage of this prior art is that three wires are required for connecting the resistors in each of the LED modules with circuitry comprised in the power supply circuit. This makes these existing LED lighting systems rather complex.

SUMMARY OF THE INVENTION

The invention aims to provide a less complex LED lighting system, that is easier to manufacture and also easier to install.

According to a first aspect of the invention a LED lighting system is provided, comprising a power supply circuit for supplying a LED current. The power supply circuit is equipped with input terminals for connection to a supply voltage source and output terminals, modulation circuitry, coupled between the input terminals and the output terminals, for alternately maintaining the voltage between the output terminals at a high level during a first time interval and a low level during a second time interval, a current sensor for sensing the current through the output terminals during the second time interval, and a driver circuit, coupled between the input terminals and the output terminals and coupled to the current sensor, for generating the LED current out of a supply voltage supplied by the supply voltage source, wherein the LED current equals the current sensed by the current sensor multiplied by a predetermined constant multiplication factor and for supplying the LED current to the output terminals during each first time interval. The LED lighting system further comprises a LED module comprising LED module input terminals for connection to the output terminals of the power supply circuit, a LED load coupled between the LED module input terminals with a forward voltage that is higher than the voltage that is present between the output terminals of the power supply circuit during each second time interval, and a current source coupled between the LED module input terminals for, in case the LED module input terminals are connected to the output terminals of a power supply source, during each second time interval generating a sensor current through the current sensor that is equal to a desired LED current divided by the predetermined constant multiplication factor.

In the LED lighting system according to the first aspect the information with respect a desired magnitude of the LED current is communicated from the LED module to the power supply circuit during each second time interval of each modulation period. An important advantage is that no wires are needed to realize this communication, so that manufacturing or installing of the LED lighting system is comparatively simple. In case more than one LED module is connected in parallel to the output terminals of the same power supply circuit, the sum of the currents generated by the current sources comprised in the LED modules flows through the current sensor and the power supply circuit and will supply a total LED current, that equals the magnitude of the current through the sensor multiplied by the predetermined constant multiplication factor, to all the LED modules together.

According to a further aspect, a method is provided for operating one or more LED modules, connected in parallel and each comprising a LED load connected between LED module input terminals and shunted by a current source, comprising the steps of:

- applying a voltage lower than the forward voltage of the LED load LS to the LED module input terminals and measuring a current flowing through a sensor and generated by the current sources comprised in the LED modules,
- raising the voltage between the LED module input terminals to a value at which the LED loads LS conduct a current and supplying a current to the LED loads LS with a magnitude that equals the measured current multiplied by a predetermined constant multiplication factor,
- repeating the first two steps.

In a first preferred embodiment of a LED lighting arrangement according to the invention, the modulation circuitry comprises a modulation switch coupled in series with a first output terminal of the power supply circuit, a control circuit coupled to a control electrode of the modulation switch, for rendering the modulation switch conductive during each first time interval and non-conductive during each second time interval, and a low voltage source, wherein the low voltage source and the current sensor are comprised in a series arrangement connecting the output terminals of the power supply circuit.

In this first preferred embodiment, the modulation circuitry is realized in a simple and dependable way. Preferably, the series arrangement of the low voltage source and the sensor comprises a diode.

In a further preferred embodiment of a LED lighting system according to the invention, the magnitude of the current generated by the current source in the LED module is temperature dependent. More in particular it is desirable that the current source generates a smaller current, in case the temperature of the LEDs in the LED module increases above a predetermined value, so that the LEDs might be damaged or the life time shortened. A smaller current generated by the current source results in a smaller LED current causing a decrease of the temperature or preventing a further increase of the temperature.

BRIEF DESCRIPTION OF THE DRAWINGS

An embodiment of a LED lighting system according to the invention will be further described, making use of a drawing.

In the drawing.

DETAILED DESCRIPTION OF AN EMBODIMENT

Figure 1:
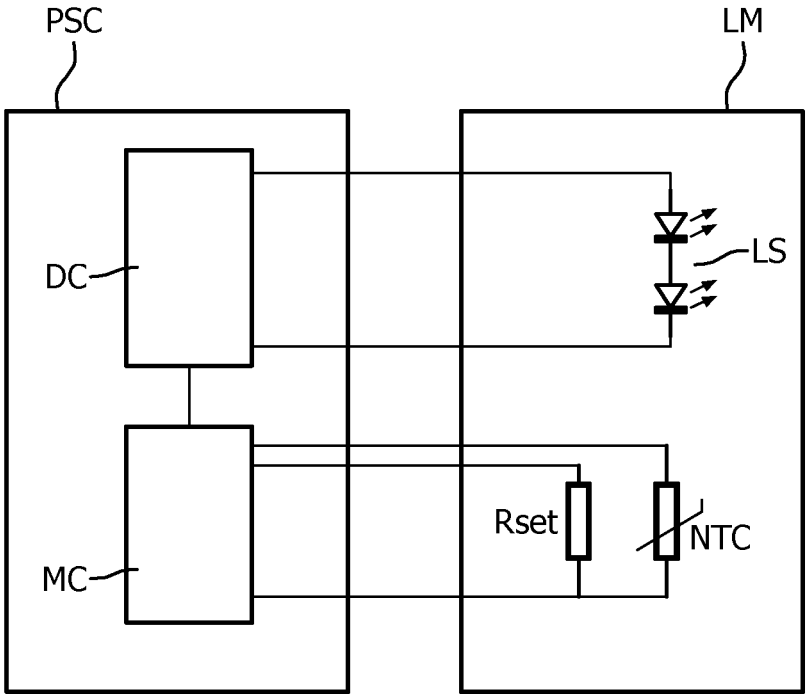
FIG. 1 shows an embodiment of a prior art LED lighting system.
Figure 2:
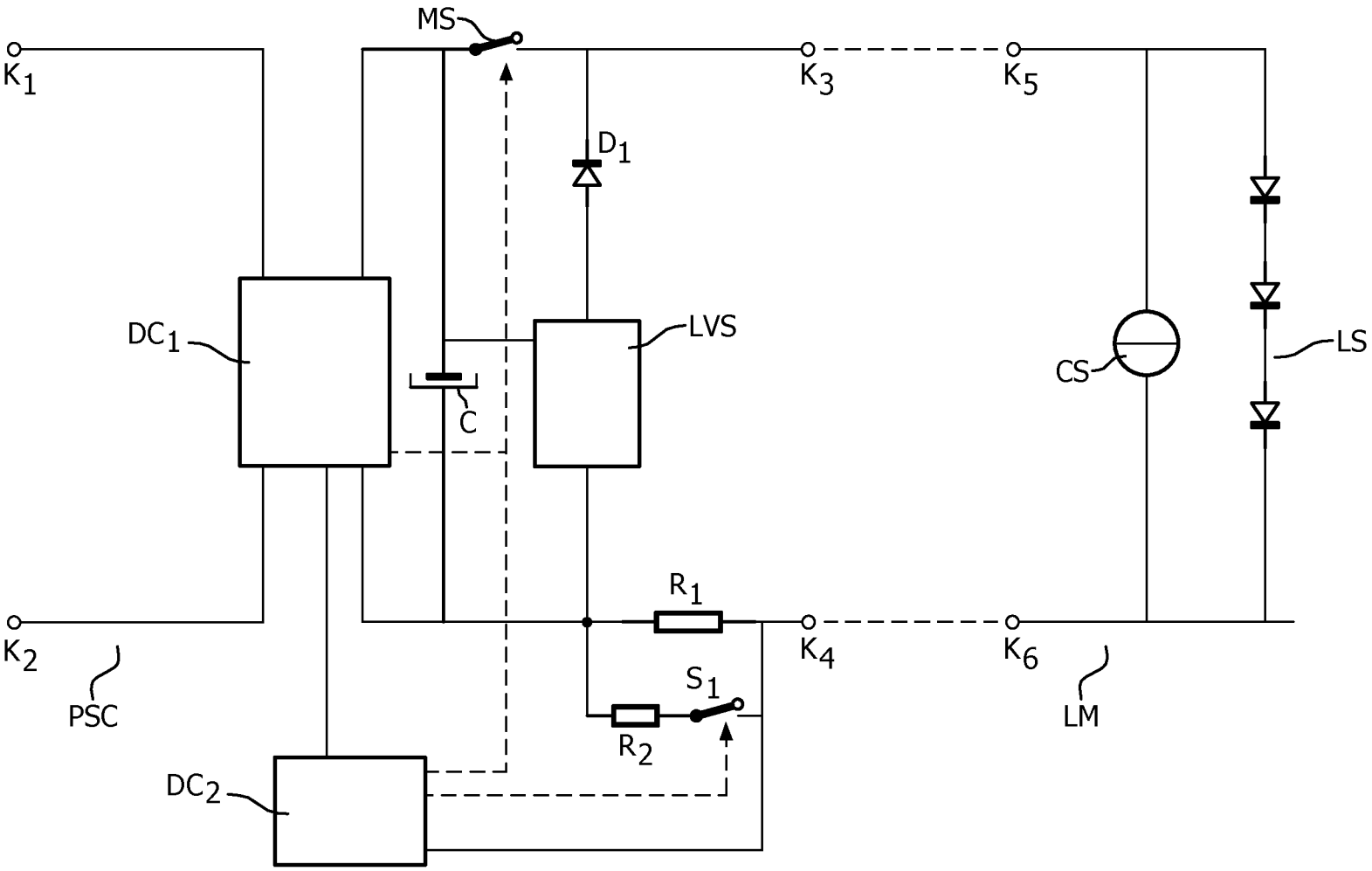
FIG. 2 shows a first embodiment of a LED lighting system according to the invention.

In FIG. 2, K1 and K2 are input terminals of a power supply circuit PSC for supplying a LED current. During operation input terminals K1 and K2 are connected to a supply voltage source. Input terminals K1 and K2 are connected to respective input terminals of a circuit part DC1 that, together with circuit part DC2, forms a driver circuit for generating the LED current out of a supply voltage supplied by the supply voltage source. First and second output terminals of the circuit part DC1 are connected by means of a capacitor C1. Capacitor C1 is shunted by a series arrangement of a modulation switch MS, a diode D1 and a circuit part LVS forming a low voltage source. A control electrode of modulation switch MS and a first input terminal of circuit part DC1 are coupled to a first output terminal of circuit part DC2, which is formed by a microcontroller. During operation circuit part DC2 renders the modulation switch alternately conductive during a first time interval and nonconductive during a second time interval. An input terminal of low voltage source LVS is connected to the first output terminal of circuit part DC1. A first output terminal K3 of power supply circuit PSC is connected to a common terminal of modulation switch MS and diode D1, and a second output terminal K4 of power supply circuit PSC is coupled to the second output terminal of circuit part DC1 via a resistor R1. Second output terminal K4 is also connected to an input terminal of circuit part DC2. Resistor R1 is shunted by a series arrangement of resistor R2 and switch S1. Resistors R1 and R2 together with switch S1 form a current sensor. A control electrode of switch S1 is connected to a second output terminal of circuit part DC2. During operation circuit part DC2 renders switch S1 alternately conductive during the first time interval and non-conductive during a second time interval. As a consequence R1 and R2 are switched parallel during each first time interval, while R2 is switched out of the circuit during each second time interval. The current sensor, formed by resistors R1 and R2 and switch S1, thus has a comparatively low resistance during each first time interval, so that the LED current does not cause a high power dissipation, and a higher resistance during each second time interval, when the current generated by the current source CS is sensed. A third output terminal of circuit part DC2 is connected to a second input terminal of circuit part DC1.

Input terminals K1 and K2, output terminals K3 and K4, circuit parts DC1 and DC2, capacitor C1, low voltage supply LVS, diode D1 and modulation switch MS, switch S1 and resistors R1 and R2 together form the power supply circuit for supplying a LED current.

K5 and K6 are first and second input terminals of a LED module LM, for connection to the output terminals of the power supply circuit. First and second input terminals K5 and K6 are connected by a current source CS and by a LED load LS. The first and second input terminals K5 and K6, the current source CS and the LED load LS together form a LED module.

The operation of the LED lighting system shown in FIG. 2 is as follows. In case the input terminals K1 and K2 are connected to a power supply source, and output terminals K3 and K4 of the power supply circuit PSC are connected to input terminals K5 and K6 of the LED module LM, a substantially constant DC voltage is present across capacitor C1. Circuit part DC2 alternately renders modulation switch MS and switch S1 conductive during a first time interval and non-conductive during a second time interval. When the modulation switch MS is conductive, the circuit part DC1 generates a LED current that is supplied to the LED string. When the modulation switch is not conductive, the voltage between the input terminals K5 and K6 of the LED module decreases to a value that is lower than the forward voltage of the LED string LS, so that the LED string LS no longer conducts a current. The output voltage of low voltage supply LVS is supplied to the current source CS, via diode D1 and current sensor R1 and the current source CS generates a current that is a predetermined fraction of the desired LED current for the LED module. Generally this current depends on the number and type of LEDs and the way they are arranged in series and in parallel. Since the LED load LS no longer carries a current, the only current carried by the current sensor is the current generated by the current source. Since the switch S1 is non-conductive during the second time interval, the resistance of the current sensor and thus the voltage across the current sensor are both comparatively high, allowing an accurate measurement of the current by circuit part DC2. At the end of the second time interval the control circuit CC renders the modulation switch MS conductive again for a time interval equal to the first time interval. During this time interval, the circuit part DC1 generates a LED current, that equals the current through the sensor, measured during the second time interval and multiplied by a predetermined constant multiplication factor, and this LED current is supplied to the LED string until the next second time interval starts. It is noted that generally the first time interval is chosen much longer than the second time interval, for instance 10 times as long.

It is noted that the current source may be constructed so that it also generates a current during each first time interval.

Alternatively, the current source CS may only generate a current during each second time interval.

As explained here-above, in case more than one LED module is connected in parallel to the output terminals of the power supply circuit, the sum of the currents generated by the current sources comprised in the LED modules flows through the sensor and the power supply circuit will supply a total LED current, that equals the magnitude of the current through the sensor (as measured during the second time interval) multiplied by the predetermined constant multiplication factor, to all the LED modules together.

The current generated by the current source is preferably temperature dependent, so that a smaller current is generated, in case the temperature of the LEDs in the LED module increases, in order to prevent that the LEDs might be damaged or their life could be shortened. A smaller current generated by the current source results in a smaller LED current causing a decrease of the temperature or preventing a further increase of the temperature.

Figure 3:
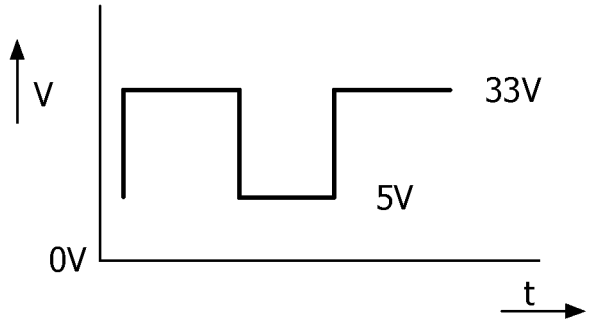
FIG. 3 shows the voltage between the output terminals of a power supply circuit comprised in a LED lighting system as shown in FIG. 2 as a function of time.

FIG. 3 is a schematic representation of the voltage present between the output terminals of the power supply circuit as a function of time for a practical realization of the LED lighting system shown in FIG. 2. It can be seen that the voltage is alternately high (33V) and low (5V) during respectively a first and a second time interval. The predetermined constant multiplication factor in this practical realization was approximately thousand.

Figure 4:
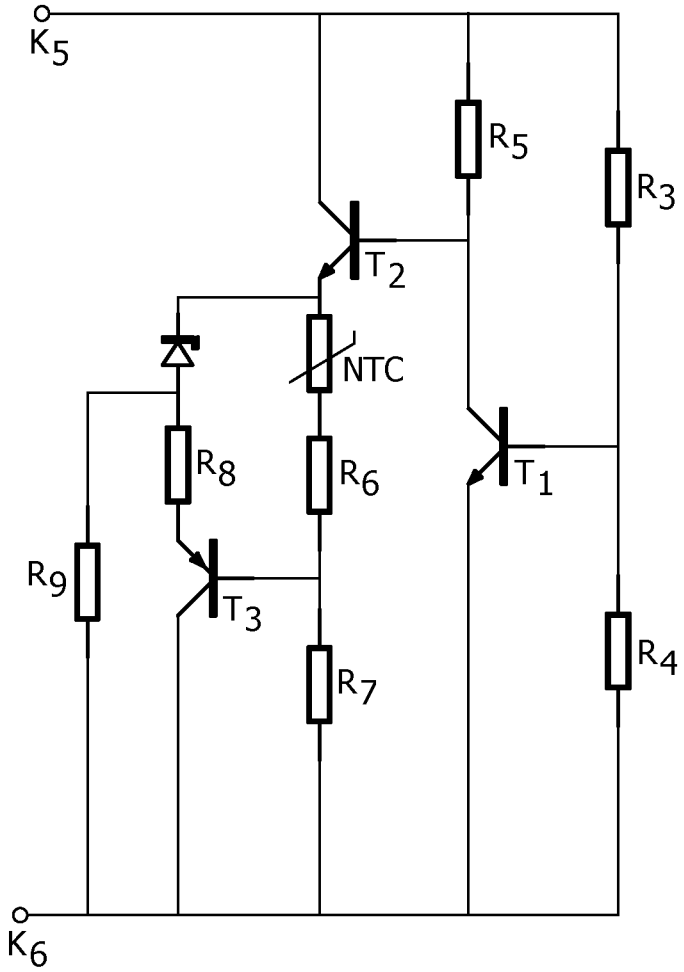
FIG. 4 shows an embodiment of the current source comprised in the embodiment shown in FIG. 2.

FIG. 4 shows an embodiment of the current source CS. The current source CS comprises temperature dependent resistor NTC. In case the temperature of the LED module increases, the current supplied by the current source CS increases.

While the invention has been illustrated and described in detail in the drawings and foregoing description, such illustration and description are to be considered illustrative or exemplary and not restrictive; the invention is not limited to the disclosed embodiments.

Variatons to the disclosed embodiments can be understood and effected by those skilled in the art in practicing the clamed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. LED lighting system comprising:

a power supply circuit for supplying a LED current, equipped with:

input terminals for connection to a supply voltage source and output terminals, modulation circuitry, coupled between the output terminals, for alternately maintaining the voltage between the output terminals at a high level during a first time interval and a low level during a second time interval, a current sensor for sensing the current through the output terminals during the second time interval, a driver circuit, coupled between the input terminals and the output terminals and coupled to the current sensor, for generating the LED current out of a supply voltage supplied by the supply voltage source, wherein the LED current equals the current sensed by the current sensor multiplied by a predetermined constant multiplication factor and for supplying the LED current to the output terminals during each first time interval, a LED module comprising:

LED module input terminals for connection to the output terminals of the power supply circuit, a LED load coupled between the LED module input terminals with a forward voltage that is higher than the voltage that is present between the output terminals of the power supply circuit during each second time interval, a current source coupled between the LED module input terminals for, in case the LED module input terminals are connected to the output terminals of a power supply source, during each second time interval generating a sensor current through the current sensor that is equal to a desired LED current divided by the predetermined constant multiplication factor.

2. LED lighting system as claimed in claim 1, wherein the modulation circuitry comprises:

a modulation switch coupled in series with a first output terminal of the power supply circuit, a control circuit coupled to a control electrode of the modulation switch, for rendering the modulation switch conductive during each first time interval and non-conductive during each second time interval, and a low voltage source, wherein the low voltage current source and the current sensor are comprised in a series arrangement connecting the output terminals of the power supply circuit.

3. LED lighting system as claimed in claim 2, wherein the series arrangement comprises a diode.

4. LED lighting system as claimed in claim 1, wherein the magnitude of the current generated by the current source is temperature dependent.

5. Method for operating one or more LED modules connected in parallel and each comprising a LED load connected between LED module input terminals and shunted by a current source, comprising the steps of:

applying, during a second time interval a low level voltage lower than the forward voltage of the LED load (LS) to the LED module input terminals, and measuring a current flowing through a sensor and generated by the current sources comprised in the LED modules, applying, during a first time interval, a high level voltage between the LED module input terminals with a value at which the LED loads (LS)conduct a current, and supplying a current to the LED loads (LS) with a magnitude that equals the measured current multiplied by a predetermined constant multiplication factor, repeating the first two steps.

* * * * *